US007068127B2

(12) United States Patent
Wilber et al.

(10) Patent No.: US 7,068,127 B2
(45) **Date of Patent: *Jun. 27, 2006**

(54) TUNABLE TRIPLE-MODE MONO-BLOCK FILTER ASSEMBLY

(75) Inventors: William D. Wilber, Neptune, NJ (US); Chi Wang, Holmdel, NJ (US); Weili Wang, Oldbridge, NJ (US)

(73) Assignee: Radio Frequency Systems, Meriden, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/987,376

(22) Filed: Nov. 14, 2001

(65) Prior Publication Data

US 2003/0090343 A1 May 15, 2003

(51) Int. Cl.
*H01P 1/20* (2006.01)
*H01P 7/00* (2006.01)

(52) U.S. Cl. ..... 333/202; 333/219.1; 333/235

(58) Field of Classification Search ..... 333/219.1, 333/202, 235, 207, 202 DB
See application file for complete search history.

(56) References Cited

U.S. PATENT DOCUMENTS 4,157,517 A * 6/1979 Kneisel et al. ..... 333/205
4,307,352 A 12/1981 Shinkawa et al. ..... 331/99
4,431,977 A 2/1984 Sokola et al.
4,607,242 A 8/1986 Cozzie ..... 333/209
4,614,920 A 9/1986 Tong
4,623,857 A 11/1986 Nishikawa et al. ..... 333/219
4,642,591 A 2/1987 Kobayashi ..... 333/227
4,653,118 A 3/1987 de Jong ..... 455/286
4,675,630 A 6/1987 Tang et al. ..... 333/208
4,691,179 A * 9/1987 Blum et al. ..... 333/202
5,083,102 A 1/1992 Zaki
5,325,077 A 6/1994 Ishikawa et al.
5,430,895 A 7/1995 Huusko ..... 455/327
5,576,674 A 11/1996 Jachowski ..... 333/212
5,589,807 A 12/1996 Tang
5,638,037 A 6/1997 Kurisu et al. ..... 333/202
5,691,676 A 11/1997 Snel et al. ..... 333/204

(Continued)

FOREIGN PATENT DOCUMENTS

EP 0742603 A1 11/1996

(Continued)

OTHER PUBLICATIONS

Patent Abstract of Japan JP02001060805A, Furuta, et al., Mar. 6, 2001.

(Continued)

*Primary Examiner*—Stephen E. Jones
(74) *Attorney, Agent, or Firm*—Sughrue Mion PLLC; TTom C. Gellenthien; V. Lawrence Sewell

(57) ABSTRACT

The present invention incorporates triple-mode, mono-block resonators that are tunable. Four novel and unobvious methods of tuning are disclosed. The first tuning method is to mechanically grind areas on three orthogonal faces of the mono-block in order to change the resonant frequencies of the three modes in each block. Another method of tuning frequency is to cut a slot within a face of the resonator. A third method of tuning the mono-block is to tune the resonant frequency of a particular mode by removing small circular areas of the conductive surface from a particular face of the mono-block. The fourth, tuning method is the use of discrete tuning elements, with 3 elements distributed among three orthogonal faces of the mono-block, to affect the necessary change of the resonant frequencies.

6 Claims, 15 Drawing Sheets

U.S. PATENT DOCUMENTS

| | | | | |
|---|---|---|---|---|
| 5,783,979 | A | 7/1998 | Andoh et al. | |
| 5,796,320 | A | 8/1998 | Hattori et al. | 333/219.1 |
| 5,821,837 | A | 10/1998 | Accatino et al. | |
| 5,859,574 | A | 1/1999 | Schmitt | |
| 5,898,349 | A | 4/1999 | Hattori et al. | 333/202 |
| 5,926,076 | A | 7/1999 | Johnson et al. | |
| 5,929,725 | A | 7/1999 | Toda et al. | 333/202 |
| 6,020,800 | A | 2/2000 | Arakawa et al. | |
| 6,072,378 | A | 6/2000 | Kurisu et al. | 333/219.1 |
| 6,081,175 | A | 6/2000 | Duong et al. | |
| 6,275,125 | B1 | 8/2001 | Takei et al. | 333/206 |
| 6,278,344 | B1 | 8/2001 | Kurisu et al. | 333/219.1 |
| 6,356,170 | B1 * | 3/2002 | Arakawa et al. | 333/208 |
| 6,359,534 | B1 | 3/2002 | Hunter | |
| 6,484,043 | B1 | 11/2002 | Klein et al. | |
| 6,507,254 | B1 | 1/2003 | Hattori et al. | |
| 6,535,086 | B1 | 3/2003 | Liang et al. | |
| 6,552,628 | B1 | 4/2003 | Jang | |
| 6,556,106 | B1 | 4/2003 | Sano | |
| 6,563,397 | B1 | 5/2003 | Jang | |
| 6,853,271 | B1 * | 2/2005 | Wilber et al. | 333/209 |
| 6,954,122 | B1 | 10/2005 | Wilber et al. | |
| 2001/0000656 | A1 | 5/2001 | Arakawa et al. | |
| 2001/0028287 | A1 * | 10/2001 | Matsumoto et al. | 333/202 |
| 2002/0003451 | A1 | 1/2002 | Theus et al. | |
| 2002/0041221 | A1 | 4/2002 | Abdulnour | |
| 2002/0093395 | A1 | 7/2002 | Jang | |
| 2002/0186103 | A1 | 12/2002 | Ando et al. | |
| 2003/0090342 | A1 | 5/2003 | Wilber et al. | |
| 2003/0090343 | A1 | 5/2003 | Wilber et al. | |
| 2003/0090344 | A1 | 5/2003 | Wang et al. | |
| 2003/0117244 | A1 | 6/2003 | Matsuura et al. | |

FOREIGN PATENT DOCUMENTS

| | | | | |
|---|---|---|---|---|
| EP | 1122807 | A1 | | 8/2001 |
| EP | 1313164 | A2 | | 5/2003 |
| EP | 1265313 | A2 | | 12/2003 |
| JP | 406177607 | A | * | 6/1994 |
| JP | 09148810 | | * | 6/1997 |
| JP | 02001060804 | A | * | 3/2001 |

OTHER PUBLICATIONS

"Six-Pole Triple Mode Filters In Rectangular Waveguide", M. Mattes, J. Mosig, M. Guglielmi, European Space Research and Technology Center, 0-7803-5687-X/00/$10.00(c) 2000 IEEE.

"Dual Mode Dielectric or Air-Filled Rectangular Waveguide Filters", IEEE Transactions on Microwave Theory and Techniques, vol. 42, No. 7, Jul. 1994, Ji-Fuh Liang, Xiao-Peng Liang, Kawthar A. Zaki and Ali E. Atia.

"Application of the Planar I/O Terminal to Dual Mode Dielectric Waveguide Filters," Kazuhisa and Sano and Meiji Miyashita, Development Division, Toko, Inc., 0-7803-5687-X/00/$10.00(c) 2000 IEEE.

A Practical Triple-Mode Monoblock, Bandpass Filter for Base Station Applications, Chi Wang, William Wilber and Bill Engst, Radio Frequency Systems, Inc., 2001 IEEE MTT-S Digest May 20, 2001.

Patent Applications of Japan. Patent No. JP 402016801A, Jan. 19, 1990, Uzawa.

"Design of Microwave Dielectric Resonators", IEEE Transactions on Microwave Theory and Techniques, vol. MT-14 No. 1, Jan. 1966, J.C. Sethares and S.J. Naumann.

"CAD of Triple-Mode Cavities in Rectangular Waveguide", IEEE Microwave and Guided Wave Letters, vol. 8. No. 10, Oct. 1998, G. Lastoria, G. Gerini, M. Guglielmi and F. Emma.

"Triple Mode Filters With Coaxial Excitation", G. Gerini, F. Diaz Bustamante, M. Guglielmi, 0-7803-5867-X/00/$10.00 (c) 2000 IEEE.

"Dual Mode Coupling by Square Corner Cut in Resonators and Filters", IEEE Transactions on Microwave Theory and Techniques, vol. 40, No. 12, Dec. 1992, Xiao-Peng Liang, Kawthar A. Zaki, and Ali E. Atia.

"A True Elliptic-Function Filter Using Triple-Mode Degenerate Cavities", IEEE Transactions on Microwave Theory and Techniques, vol. MTT-32, No. 11, Nov. 1984, Wai-Cheung Tang, and Sujeet K. Caudhuri.

A Grooved Monoblock Comb-Like Filter Suppressing the Third Harmonics; EX 002030374, Yoji Isota, et al., pp. 383-386, 1987.

Tikhov et al., "A Novel Surface Mount Filter Based on a Triple-Mode Ceramic Cavity", Radio and Wireless Conference, 2001, RAWCON 2001, IEEE, Aug. 19-22, 2001, pp. 161-164.

Technical Glossary, Basic Terminology for Quartz Crystal Resonators, http://www.4timing.com/termcrystal.htm.

Ceramic Resonator Glossary, Caliber Electronics, http://www.caliberelectronics.com.

Microwaves, Metal and Arcing, Excerpts from the book The Complete Microwave Oven Service Handbook, http://www.gallawa.com/microtech/metal_arc.html.

Spurious Couplings Degrade Bandpass Filter Performance, Kurzrok, MWRF Oct. 1999, http://www.microwavesrf.com/Globals/PlanetEE/dsp/article.cfm.

Generalized Multi-Layer Compline and Dielectric Loaded Resonators for CAD of High Performance Base Station Filters, Wang t al, Progress in Electromagnetics Research Symposium, Jul. 5-14, 2000, Cambridge, MA, USA.

TEM Mode Dielectric Combline, FSY Microwave, Inc., http://www.fsmicrowave.com/temcomb.htm.

Cavity and Surface-Mount Delay Line Filters for Feedforward Power Amplifiers, K&L Microwave, Inc., Sep. 1999, pp. 1-5.

Product Definitions—Delay Lines; http://www.rhombus-ind.com/prodefin.html, Oct. 11, 2005.

The Website for Mobile Comunications EMC Technology, Inc. RF resistive Products, Attenuators, Power Sensing Terminations, Thermopads and Delay Lines, http://www.mobilecomms-technology.com/contractos/electronic-components/emc/, Aug. 2, 2002.

MDP Microwave Products Digest, Sep. 2001, Variable Delay Lines Enhance Feedforward Power Amplifies and Bypass Applications, Lilly, et al, http://www.mpdigest.com/Articles/Sept2001/etenna/Default.htm.

Using Resonated Couplings in Filters, RS Microwave Techonlogy Center, May 1997, http://rf.rfglobalnet.com/library/ProductNotes/files/6/5-97tech.tm.

Doust et al., Satellite Mutliplexing Using Dielectric Resonators Filters, Dec. 1989 Microwave Journal, pp. 93-106.

* cited by examiner

TUNABLE TRIPLE-MODE MONO-BLOCK FILTER ASSEMBLY

FIELD OF THE INVENTION

This invention relates to filter assemblies. More particularly, this invention discloses triple-mode, mono-block resonators that are smaller and less costly than comparable metallic combline resonators.

BACKGROUND OF THE INVENTION

When generating signals in communication systems, combline filters are used to reject unwanted signals. Current combline filter structures consist of a series of metallic resonators dispersed in a metallic housing. Because of the required volume for each resonator, the metallic housing cannot be reduced in size beyond current technology, typically 3–10 cubic inches/resonator, depending on the operating frequency and the maximum insertion loss. Furthermore, the metallic housing represents a major cost percentage of the entire filter assembly. Consequently, current metallic filters are too large and too costly.

SUMMARY OF THE INVENTION

In a preferred embodiment, the invention is a method and apparatus of tuning a filter assembly comprising a block resonator filter by cutting a slot within a face of said block resonator filter.

In another preferred embodiment, the invention is a method and apparatus of tuning a filter assembly comprising a block resonator filter by removing small circular areas of a conductive surface from a face of said block resonator filter.

In still another preferred embodiment, the invention is a method and apparatus of tuning a filter assembly comprising a block resonator filter by grinding areas on a plurality of orthogonal faces of said block resonator filter to change the resonant frequencies of modes in said block.

In still another preferred embodiment, the invention is a method and apparatus of tuning a filter assembly comprising a block resonator filter by using at least one tuning cylinder among a plurality of orthogonal faces of said block resonator filter to tune said filter.

BRIEF DESCRIPTION OF THE DRAWINGS

FIG. 1*b* is a view showing a probe inserted into the mono-block.

FIG. 16 is a photograph of the mask filter.

DETAILED DESCRIPTION OF ONE EMBODIMENT OF THE INVENTION

It is desirable to reduce the size and cost of the filter assemblies beyond what is currently possible with metallic combline structures which are presently used to attenuate undesired signals. The present invention incorporates triple-mode resonators into an assembly that includes a mask filter and a low pass filter such that the entire assembly provides the extended frequency range attenuation of the unwanted signal. The assembly is integrated in a way that minimizes the required volume and affords easy mounting onto a circuit board.

Triple-Mode Mono-Block Cavity

Filters employing triple-mode mono-block cavities afford the opportunity of significantly reducing the overall volume of the filter package and reducing cost, while maintaining acceptable electrical performance. The size reduction has two sources. First, a triple-mode mono-block resonator has three resonators in one block. (Each resonator provides one pole to the filter response). This provides a 3-fold reduction in size compared to filters currently used which disclose one resonator per block. Secondly, the resonators are not air-filled coaxial resonators as in the standard combline construction, but are now dielectric-filled blocks. In a preferred embodiment, they are a solid block of ceramic coated with a conductive metal layer, typically silver. The high dielectric constant material allows the resonator to shrink in size by approximately the square root of the dielectric constant, while maintaining the same operating frequency. In a preferred embodiment, the ceramic used has a dielectric constant between 35 and 36 and a Q of 2,000. In another embodiment, the dielectric constant is 44 with a Q of 1,500. Although the Q is lower, the resonator is smaller due to the higher dielectric constant. In still another preferred embodiment, the dielectric constant is 21 with a Q of 3,000.

Furthermore, because the mono-block cavities are self-contained resonators, no metallic housing is required. The cost reduction from eliminating the metallic housing is greater than the additional cost of using dielectric-filled resonators as opposed to air-filled resonators.

The concept of a mono-block is not new. However, this is the first triple-mode mono-block resonator. In addition, the ability to package the plated mono-block triple-mode resonator filled with low loss, high dielectric constant material into a practical filter and assembly is novel and unobvious.

Figure 1A:
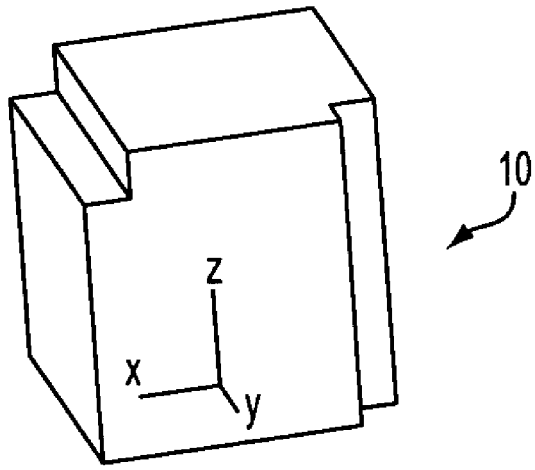
FIGS. 1*a* and 1*b* are two views of the fundamental triple-mode mono-block shape.
Figure 1B:
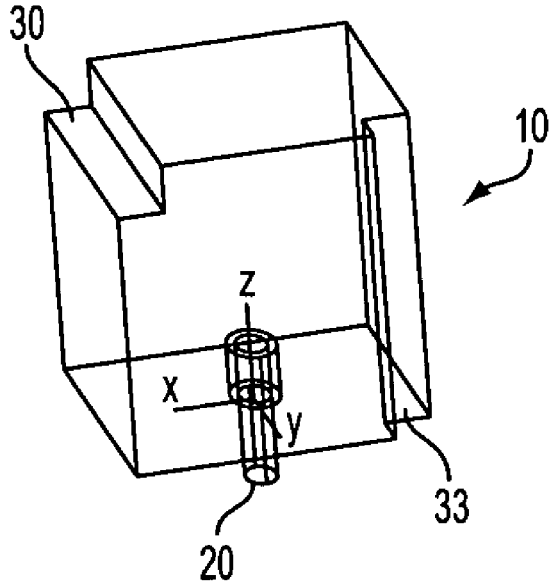

The basic design for a triple-mode mono-block resonator 10 is shown in FIG. 1 in which two views 1(*a*) and 1(*b*) are shown of the fundamental triple-mode mono-block shape. It is an approximately cubic block. The three modes that are excited are the $TE_{110}$, $TE_{101}$ and $TE_{011}$ modes. See J. C. Sethares and S. J. Naumann, "Design of Microwave Dielectric Resonators," IEEE Trans. Microwave Theory Tech., pp. 2–7, January 1966, hereby incorporated by reference. The three modes are mutually orthogonal. The design is an improvement to the triple-mode design for a rectangular (hollow) waveguide described in G. Lastoria, G. Gerini, M. Guglielmi and F. Emma, "CAD of Triple-Mode Cavities in Rectangular Waveguide," IEEE Trans. Microwave Theory Tech., pp. 339–341, October 1998, hereby incorporated by reference.

The three resonant modes in a triple-mode mono-block resonator are typically denoted as TE011, TE101, and TE110 (or sometimes as TE□11, TE1□1, and TE11□), where TE indicates a transverse electric mode, and the three successive indices (often written as subscripts) indicate the number of half-wavelengths along the x, y and z directions. For example, TE101 indicates that the resonant mode will have an electric field that varies in phase by 180 degrees (one-half wavelength) along the x and z directions, and there is no variation along the y direction. For this discussion, we will refer to the TE110 mode as Mode 1, TE101 as Mode 2, and TE011 as mode 3.

Corner Cuts

Figure 2:
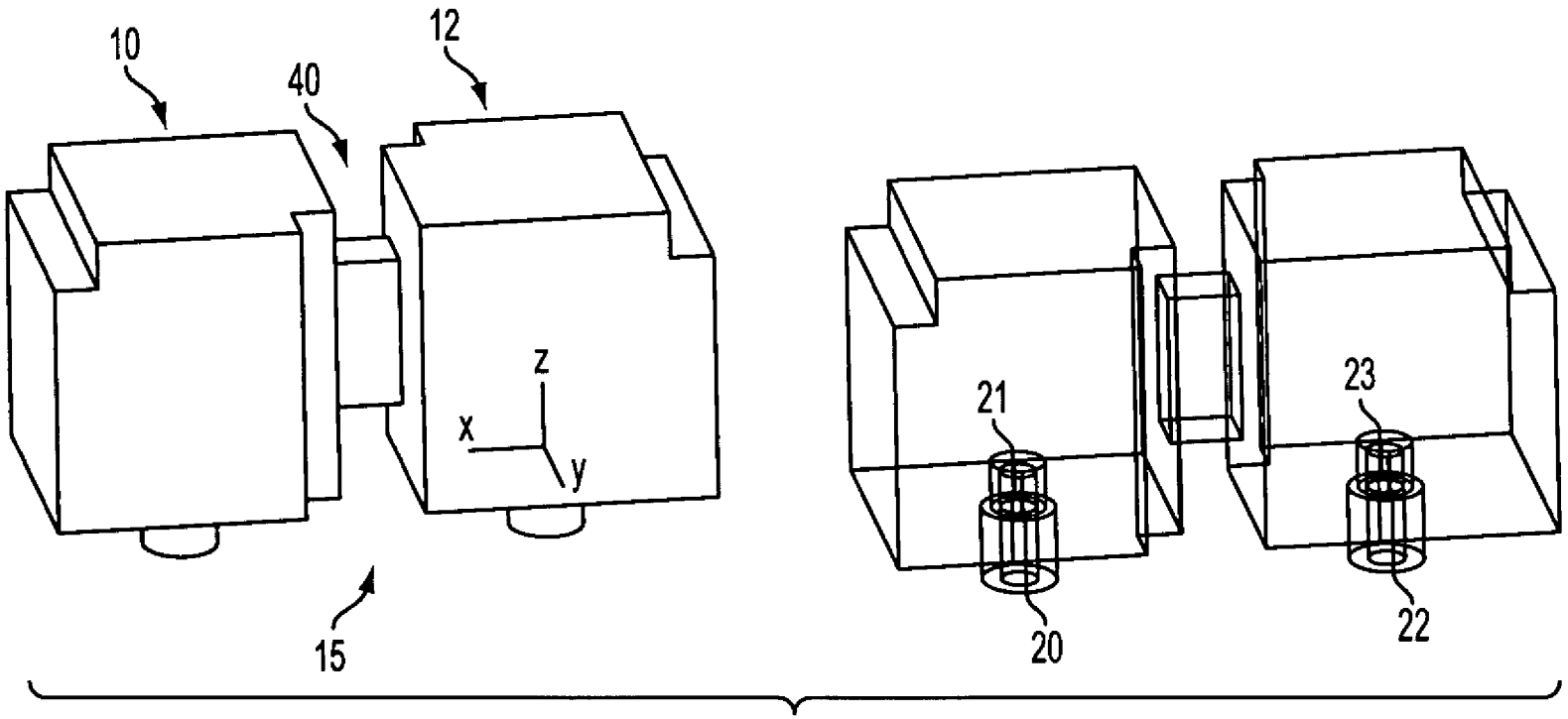
FIGS. 2*a* and 2*b* are solid and wire-frame views of two mono-blocks connected together to form a 6-pole filter.

The input and output power is coupled to and from the mono-block 10 by a probe 20 inserted into an input/output port 21 in the mono-block 10 as seen in FIG. 1(*b*). The probe can be part of an external coaxial line, or can be connected to some other external circuit. The coupling between modes is accomplished by corner cuts 30, 33. One is oriented along the Y axis 30 and one is oriented along the Z axis 33. The two corner cuts are used to couple modes 1 and 2 and modes 2 and 3. In addition to the corner cuts shown in FIG. 1, a third corner cut along the X axis can be used to cross-couple modes 1 and 3. FIG. 2 is a solid and a wire-frame view showing two of the triple-mode mono-blocks connected together 10, 12 to form a six-pole filter 15 (each triple-mode mono-block resonator has 3 poles). A connecting aperture or waveguide 40 links windows in each of the blocks together. The aperture can be air or a dielectric material. The input/output ports 21, 23 on this filter are shown as coaxial lines connected to the probes 20, 22 (see FIG. 1) in each block 10, 12.

Corner cuts 30, 33 are used to couple a mode oriented in one direction to a mode oriented in a second mutually orthogonal direction. Each coupling represents one pole in the filter's response. Therefore, the triple-mode mono-block discussed above represents the equivalent of three poles or three electrical resonators.

Figure 3A:
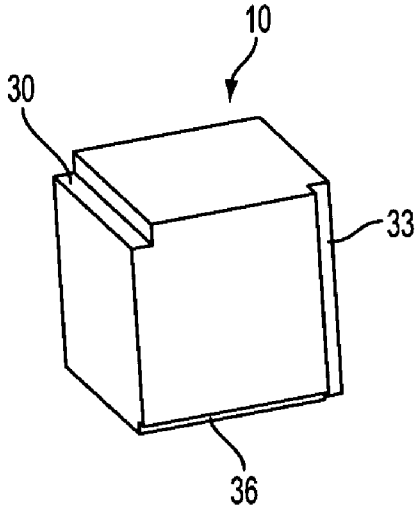
FIGS. 3*a* and 3*b* are solid and wire-frame views of the mono-block with a third corner cut.
Figure 3B:
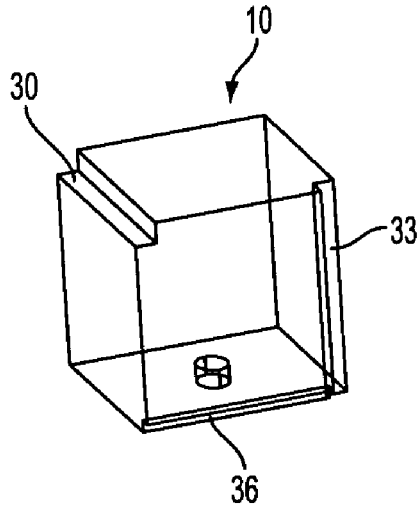

FIG. 3 shows a third corner cut 36 (on the bottom for this example) that provides a cross coupling between modes 1 and 3 in the mono-block. A solid block is shown in part 3(*a*) and a wire frame view is shown in 3(*b*). By the appropriate choice of the particular block edge for this corner cut, either positive or negative cross coupling is possible.

Tuning

Tuning: Like most other high precision, radio frequency filters, the filter disclosed here is tuned to optimize the filter response. Mechanical tolerances and uncertainty in the dielectric constant necessitate the tuning. The ability to tune, or adjust, the resonant frequencies of the triple-mode mono-block resonator 10 enhances the manufacturability of a filter assembly that employs triple-mode mono-blocks 10 as resonant elements. Ideally, one should be able to tune each of the three resonant modes in the mono-block independently of each other. In addition, one should be able to tune a mode's resonant frequency either higher or lower.

Four novel and unobvious methods of tuning are disclosed. The first tuning method is to mechanically grind areas on three orthogonal faces of the mono-block 10 in order to change the resonant frequencies of the three modes in each block. By grinding the areas, ceramic dielectric material is removed, thereby changing the resonant frequencies of the resonant modes.

This method is mechanically simple, but is complicated by the fact that the grinding of one face of the mono-block 10 will affect the resonant frequencies of all three modes. A computer-aided analysis is required for the production environment, whereby the affect of grinding a given amount of material away from a given face is known and controlled.

Figure 4:
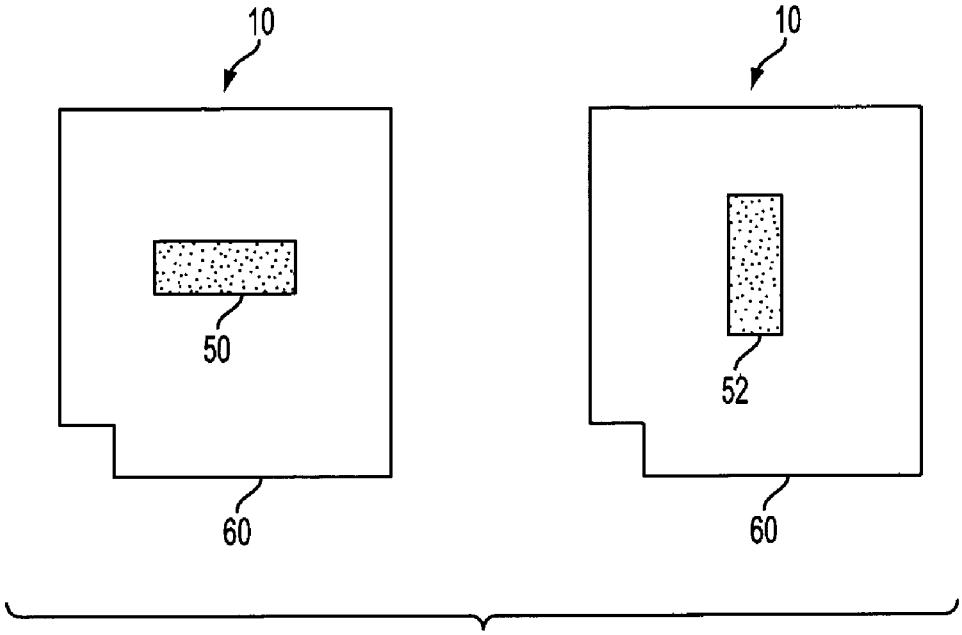
FIG. 4 illustrates a slot cut within a face of the resonator.
Figure 5:
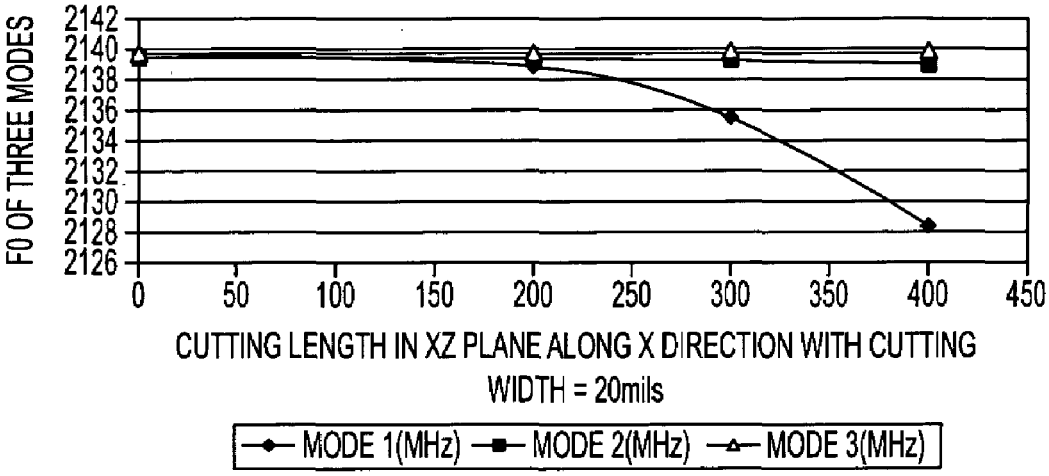
FIG. 5 is a graph of resonant frequencies of Modes 1, 2 and 3 vs. cutting length for a slot cut along the X-direction on the X-Z face.

Another method of tuning frequency is to cut a slot 50, 52 within a face 60 of the resonator 10 (see FIG. 4). By simply cutting the proper slots 50, 52 in the conductive layer, one can tune any particular mode to a lower frequency. The longer the slot 50, 52, the greater the amount that the frequency is lowered. The advantage behind using this method of tuning is that the resonant frequency of the other two modes is unaffected. For example, cutting a slot 50, 52 along the X-direction in either X-Z face (or plane) 60 of the mono-block 10 will cause the resonant frequency of Mode 1 to decrease as shown in FIG. 5. For this particular example, the mono-block 10 consists of a ceramic block with a dielectric constant=21.65, an X dimension of 0.942 inches, a Y-dimension of 0.916 inches, and a Z-dimension of 0.935 inches. The slot width is 0.020 inches, and the resonant frequency varies with the length of the slot as shown in FIG. 5. Note that while the frequency of Mode 1 changes, the frequencies of Modes 2 and 3 are left relatively unchanged.

Figure 6:
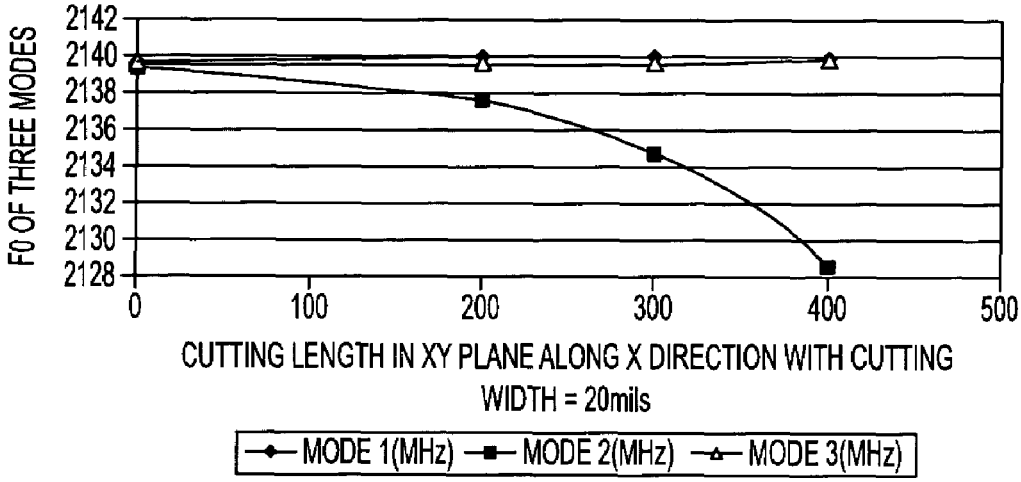
FIG. 6 is a graph of resonant frequencies of Modes 1, 2 and 3 vs. cutting length for a slot cut along the X-direction on the X-Y face.

In a similar fashion, FIG. 6 shows that for a slot 50, 52 on the X-Y face (or plane) 60, cut along the X-direction, the frequency of Mode 2 will decrease with the slot length as shown, and leave the frequencies for Modes 1 and 3 relatively unchanged.

Figure 7:
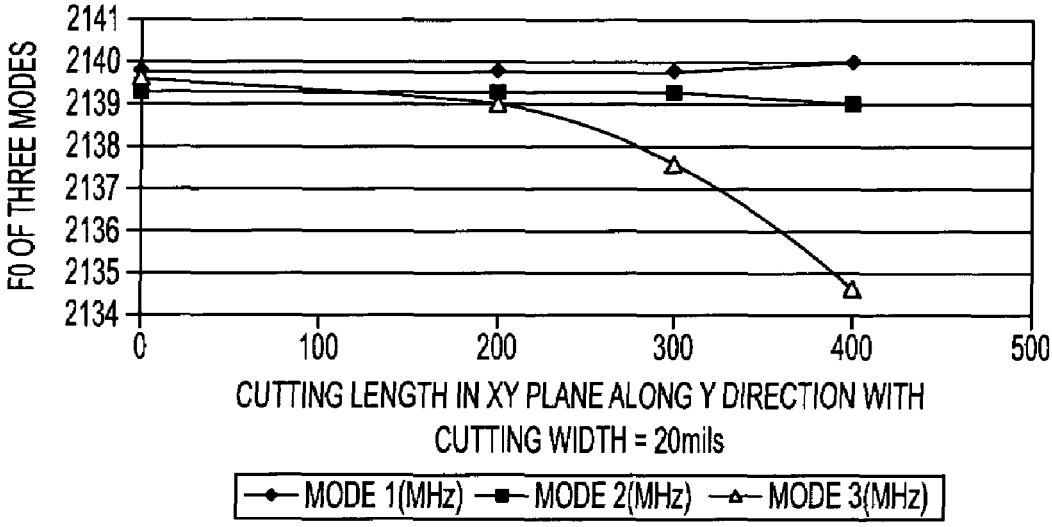
FIG. 7 is a graph of resonant frequencies of Modes 1, 2 and 3 vs. cutting length for a slot cut along the Y-direction on the X-Y face.

FIG. 7 shows that for a slot 50, 52 on the X-Y face (or plane) 60, but cut along the Y-direction, the frequency of Mode 3 is now tuned lower. Comparing these data with the data shown in FIG. 6, it is seen that the direction of the slot and the orientation of the face determine which mode is to be tuned. Table 1 shows which mode will be tuned for a given set of conditions.

TABLE 1

Resonant-mode tuning selection as a function of slot direction and block face.

| | X-direction | Y-direction | Z-direction |
|---|---|---|---|
| X-Y Face | Mode 2 | Mode 3 | Not Allowed |
| X-Z Face | Mode 1 | Not Allowed | Mode 3 |
| Y-Z Face | Not Allowed | Mode 1 | Mode 2 |

Figure 8A:
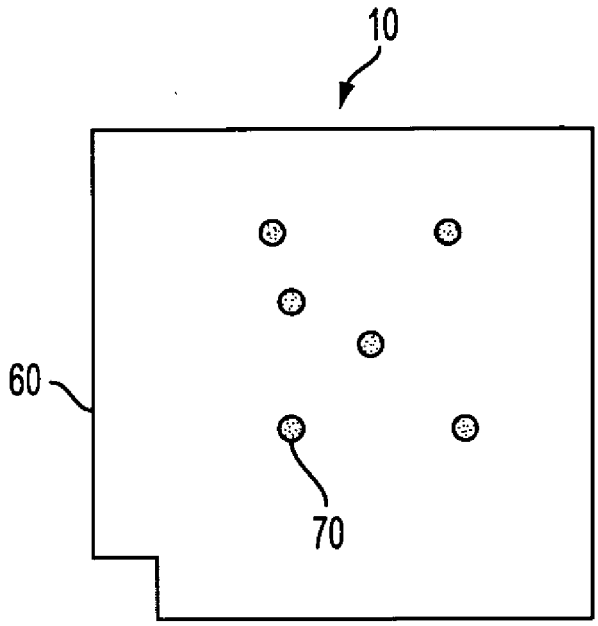
FIG. 8*a* illustrates a method of tuning the mono-block by removing small circular areas of the conductive surface from a particular face of the mono-block.
Figure 8B:
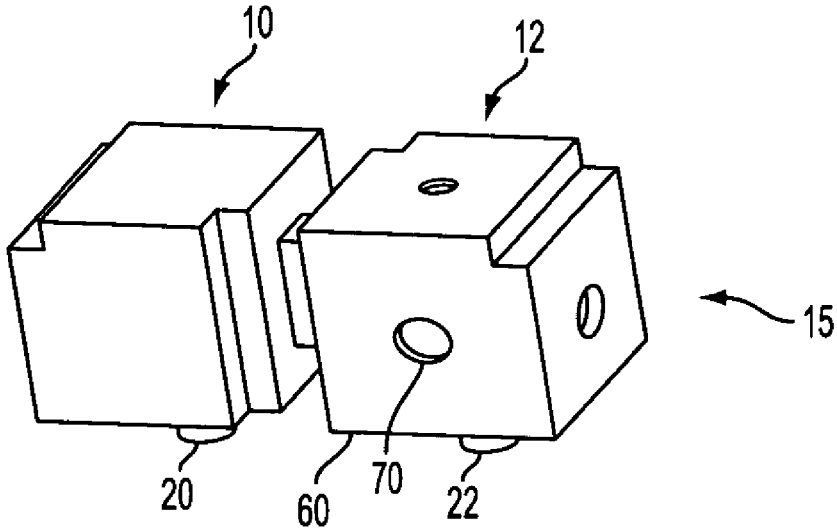
FIG. 8*b* illustrates tuning resonant frequencies of the three modes in the block using indentations or circles in three orthogonal sides.
Figure 9:
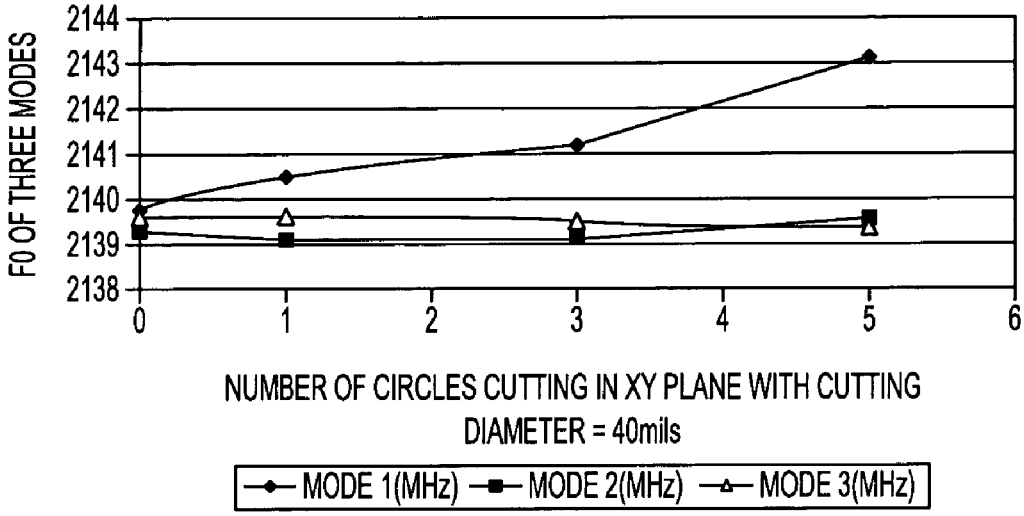
FIG. 9 is a graph showing the change in frequency for Mode 1 when successive circles are cut away from the X-Y face of the mono-block.

A third method of tuning the mono-block 10 is to tune the resonant frequency of a particular mode to a higher frequency by removing small circular areas 70 of the conductive surface from a particular face (or plane) of the mono-block 10 (see FIGS. 8*a* and *b*). FIG. 9 shows the change in frequency for Mode 1 when successive circles 70 (diameter=0.040 inches) close to the face center are cut away from the X-Y face (or plane) 60 of the mono-block 10. In a similar fashion, one can tune Mode 2 to a higher frequency by removing small circles 70 of metal from the X-Z face (or plane) 60, and one can tune Mode 3 to higher frequency by the same process applied to the Y-Z face (or plane) 60. Note that, in FIG. 9, Modes 2 and 3 are relatively unchanged while the frequency of Mode 1 increases. The depth of the hole affects the frequency. Once again, only the frequency of one of the coupled modes is affected using this method. The resonant frequency of the other two modes is unaffected. The metal can be removed by a number of means including grinding, laser cutting, chemically etching, electric discharge machining or other means. FIG. 8(*b*) shows the use of three circles (or indentations) 70 on three orthogonal faces 60 of one of two triple-mode mono-blocks 10, 12 connected together. They are used to adjust the resonant frequencies of the three modes in the one block 12. Tuning for only one block is shown in this figure. Tuning for the second block (the one on the left) 10 would be similar.

Figure 10A:
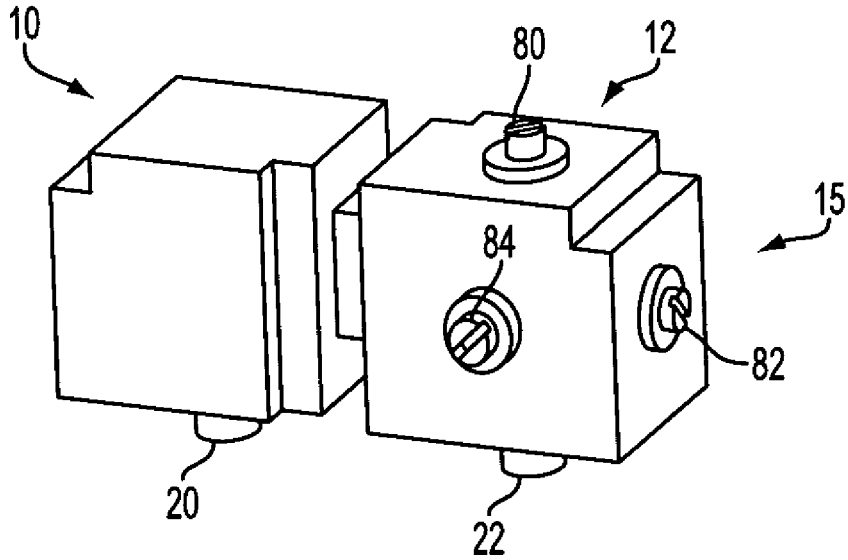
FIGS. 10*a* and *b* illustrate tuning resonant frequencies of the three modes in the block using metallic or dielectric tuners attached to three orthogonal sides (FIG. 10*a*), or metallic or dielectric tuners protruding into the mono-block (FIG. 10*b*).
Figure 10B:
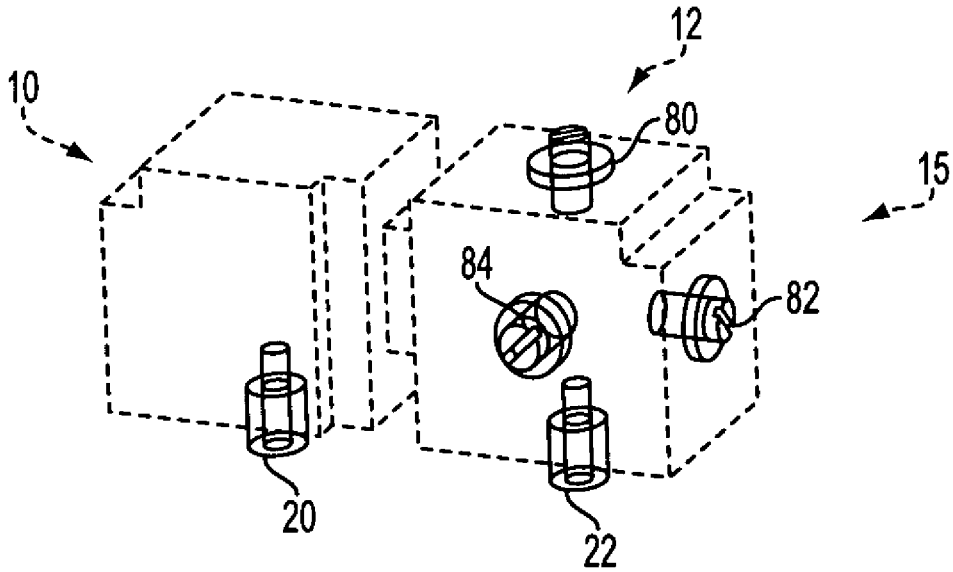
Figure 11D:
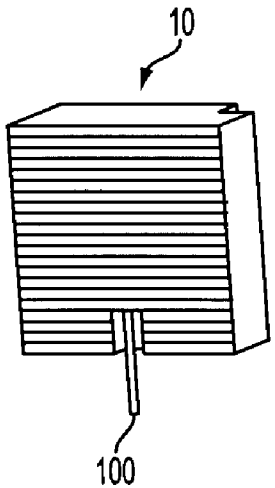
FIGS. 11*a, b, c* and *d* illustrate a method for the input/output coupling for the triple-mode mono-block filter.
Figure 11C:
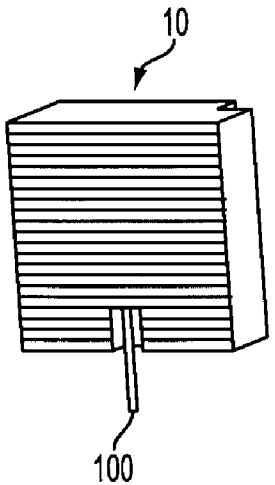
Figure 11B:
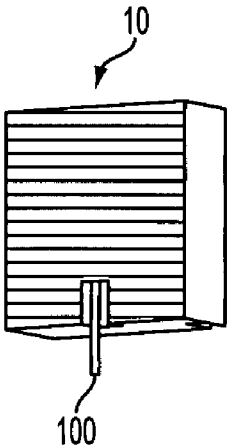
Figure 11A:
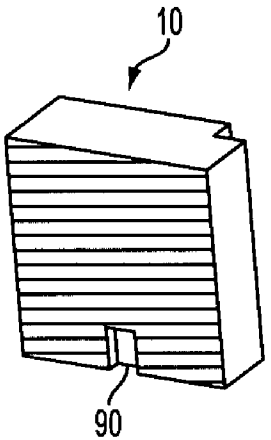

The fourth tuning method disclosed here is the use of discrete tuning elements or cylinders 80, 82, 84. FIGS. 10(*a*) and 10(*b*) show the 3 elements 80, 82, 84 distributed among three orthogonal faces 60 of the mono-block 10, to affect the necessary change of the resonant frequencies. FIG. 10(*a*) shows an alternate method for tuning whereby metallic or dielectric tuners are attached to three orthogonal sides and the metallic or dielectric elements protrude into the mono-block 10, as shown in FIG. 10(*b*). Tuning for only one block is shown in this figure. Tuning for the second block (the block on the left) would be similar. The tuning elements 80, 82, 84 can be metallic elements which are available from commercial sources. (See, for example, the metallic tuning elements available from Johanson Manufacturing, http://www.johansonmfg.com/mte.htm#.) One could also use dielectric tuning elements, also available from commercial sources (again, see Johanson Manufacturing, for example).

The description above is focused mainly on the use of a triple-mode mono-block 10 in a filter. It should be understood that this disclosure also covers the use of the triple-mode mono-block filter as part of a multiplexer, where two or more filters are connected to a common port. One or more of the multiple filters could be formed from the triple-mode mono-blocks.

Input/Output

Input/Output: A proper method for transmitting a microwave signal into (input) and out of (output) the triple-mode mono-block filter is by the use of probes. The input probe excites an RF wave comprising of a plurality of modes. The corner cuts then couple the different modes. K. Sano and M. Miyashita, "Application of the Planar I/O Terminal to Dual-Mode Dielectric-Waveguide Filter," IEEE Trans. Microwave Theory Tech., pp. 2491–2495, December 2000, hereby incorporated by reference, discloses a dual-mode mono-block having an input/output terminal which functions as as a patch antenna to radiate power into and out of the mono-block.

The method disclosed in the present invention is to form an indentation 90 in the mono-block (in particular, a cylindrical hole was used here), plate the interior of that hole 90 with a conductor (typically, but not necessarily, silver), and then connect the metallic surface to a circuit external to the filter/mono-block, as shown in FIG. 11. The form of the connection from the metallic plating to the external circuit can take one of several forms, as shown in FIG. 11 in which the interior or inner diameter of a hole or indentation is plated with metal (FIG. 11(*a*)). Next, an electrical connection 100 is fixed from the metal in the hole/indentation 90 to an external circuit, thus forming a reproducible method for transmitting a signal into or out of the triple-mode mono-block 10. In FIG. 11(*b*) a wire is soldered to the plating to form the electrical connection 100, in FIG. 11(*c*) a press-in connector 100 is used and in FIG. 11(*d*) the indentation is filled with metal including the wire 100.

Since the probe 100 is integrated into the mono-block 10, play between the probe and the block is reduced. This is an improvement over the prior art where an external probe 100 was inserted into a hole 90 in the block 100. Power handling problems occurred due to gaps between the probe 100 and the hole 90.

Integrated Filter Assembly Comprising a Preselect or Mask Filter, a Triple-Mode Mono-Block Resonator and a Low-Pass Filter Several features/techniques have been developed to make the triple-mode mono-block filter a practical device. These features and techniques are described below and form the claims for this disclosure.

Figure 12A:
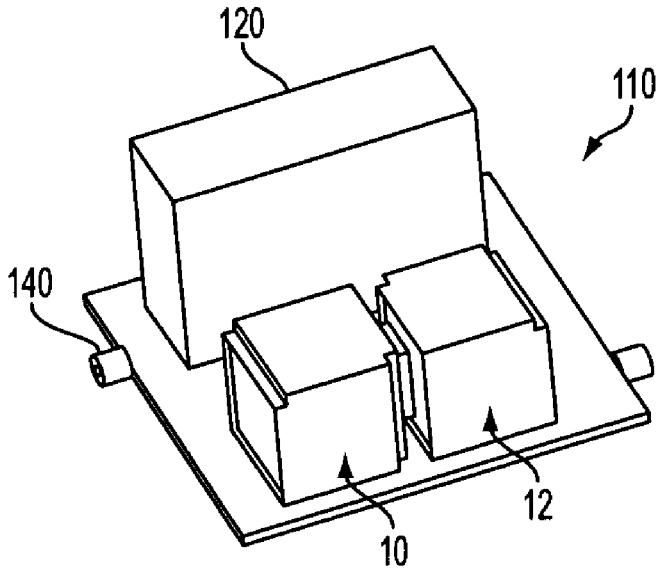
FIG. 12 illustrates an assembly configuration in which the low pass filter is fabricated on the same circuit board that supports the mono-block filter and mask filter.
Figure 12B:
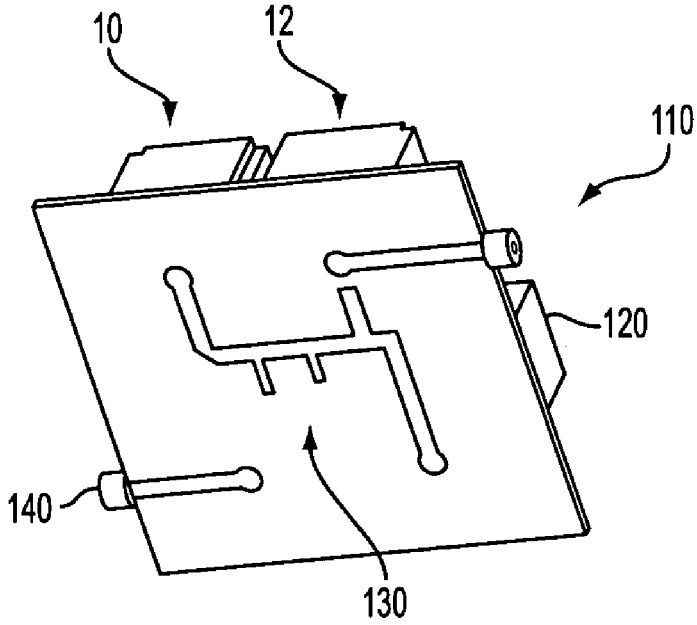

Filter Assembly: The novel and unobvious filter assembly 110 consisting of three parts, the mono-block resonator 10, premask (or mask) 120, and low-pass filters 130, can take one of several embodiments. In one embodiment, the three filter elements are combined as shown in FIG. 12*a*, with connections provided by coaxial connectors 140 to the common circuit board. In this embodiment, the LPF 130 is etched right on the common circuit board as shown in FIG. 12*b*. The low pass filter 130 is fabricated in microstrip on the same circuit board that supports the mono-block filter 10, 12 and the mask 120 filter. The low pass filter 130 shown in FIG. 12 consists of three open-ended stubs and their connecting sections. The low pass filter 130 design may change as required by different specifications.

Figure 13:
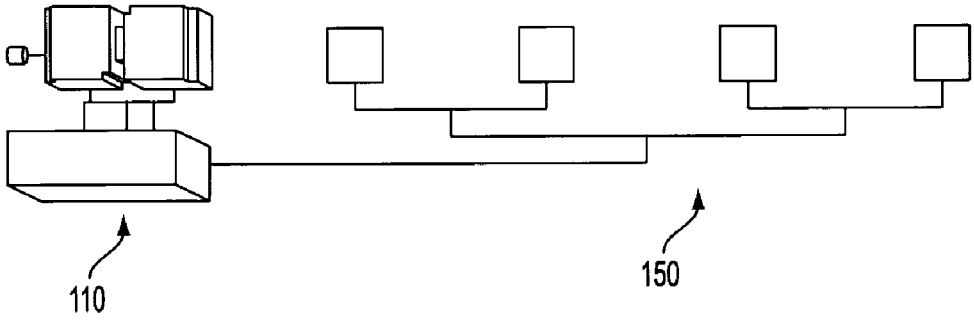
FIG. 13 illustrates an assembly in which the mono-block filter and combline filter are mounted to the same board that supports a 4-element antenna array.

In a second embodiment, the circuit board supporting the filter assembly 110 is an integral part of the circuit board that is formed by other parts of the transmit and/or receive system, such as the antenna, amplifier, or analog to digital converter. As an example, FIG. 13 shows the filter assembly 110 on the same board as a 4-element microstrip-patch antenna array 150. The mono-block filter 10, 12 and combline (or premask) filter 120 are mounted to the same board that supports a 4-element antenna array 150. The mono-block 10 and mask filters 120 are on one side of the circuit board. The low pass filter 130 and the antenna 150 are on the opposite side. A housing could be included, as needed.

Figure 14A:
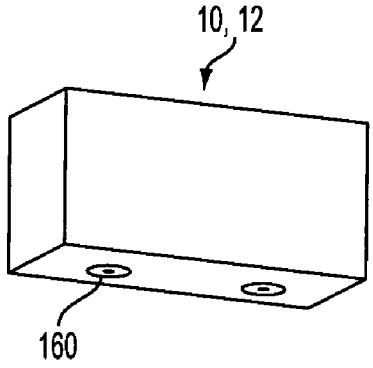
FIGS. 14*a, b* and *c* illustrate a mono-block filter packaged in a box (FIG. 14*a*), with internal features highlighted (FIG. 14*b*).
Figure 14B:
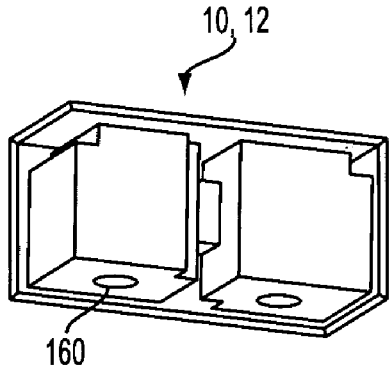
FIG. 14*c* shows a similar package for a duplexer.
Figure 14C:
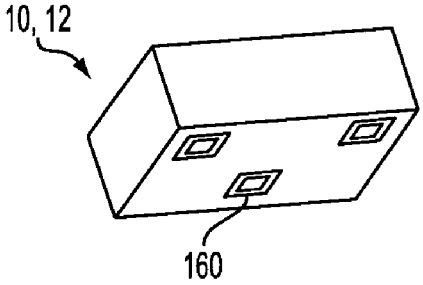

In a third embodiment, the filter assembly 110 is contained in a box and connectors are provided either as coaxial connectors or as pads that can be soldered to another circuit board in a standard soldering operation. FIG. 14 shows two examples of packages with pads 160. The filter package can include cooling fins if required. A package of the type shown in FIG. 14 may contain only the mono-block 10, 12, as shown, or it may contain a filter assembly 110 of the type shown in FIG. 13. FIG. 14(*a*) shows the mono-block filter 10, 12 packaged in a box with the internal features highlighted in FIG. 14(*b*). The pads 160 on the bottom of the box in FIG. 14(*a*) would be soldered to a circuit board. FIG. 14(*c*) shows a similar package for a duplexer consisting of two filters with one common port and, therefore, three connecting pads 160. A package of the type shown here may contain only the mono-block 10, 12 or it may contain a filter assembly 110.

Figure 15:
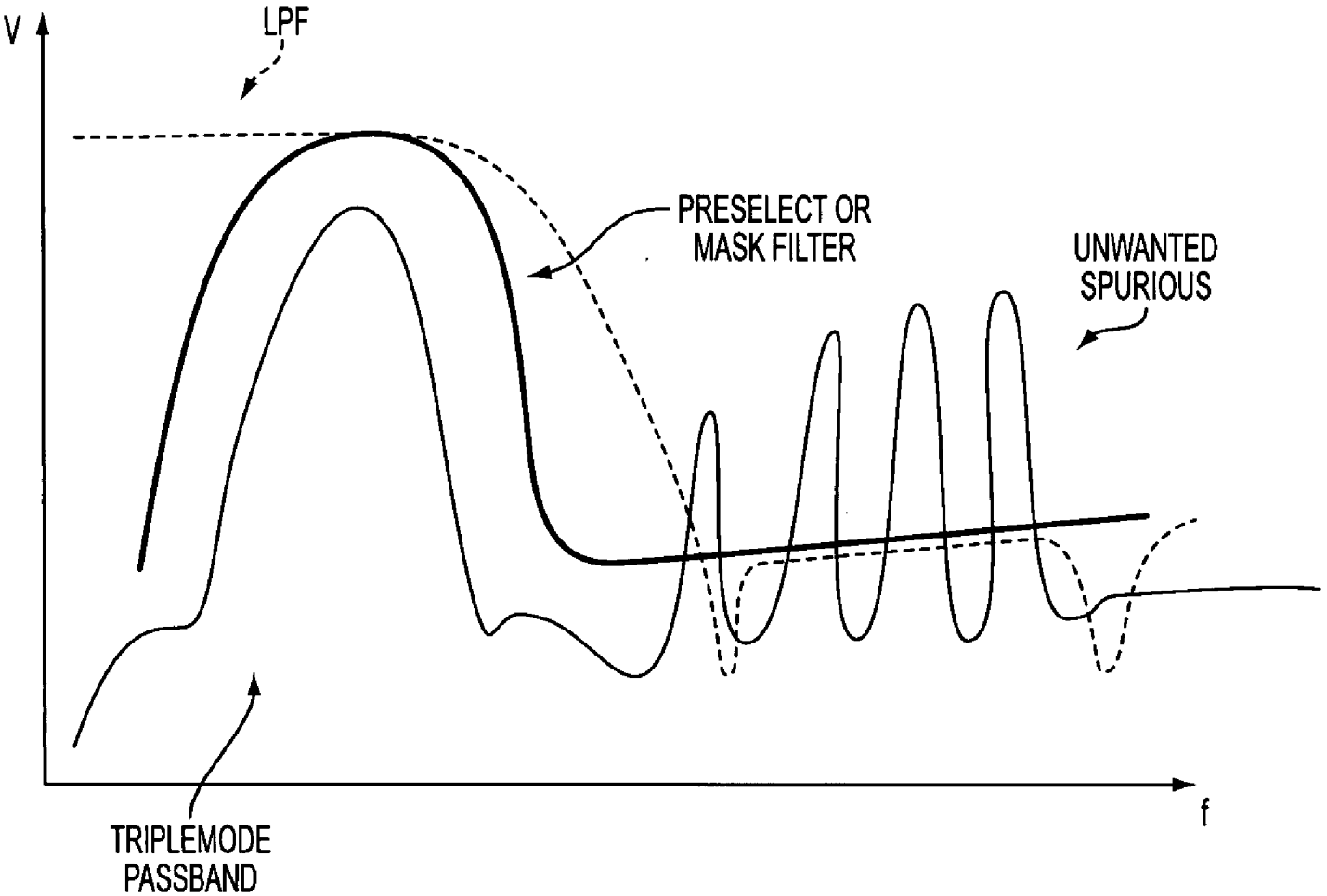
FIG. 15 illustrates the low-pass filter (LPF), the preselect or mask filter and the triple-mode mono-block passband response.

Preselect or Mask Filter: Common to any resonant device such as a filter is the problem of unwanted spurious modes, or unwanted resonances. This problem is especially pronounced in multi-mode resonators like the triple-mode mono-block 10, 12. For a triple-mode mono-block 10, 12 designed for a pass band centered at 1.95 GHz, the first resonance will occur near 2.4 GHz. In order to alleviate this problem, we disclose the use of a relatively wide-bandwidth mask filter 120, packaged with the mono-block filter 10, 12. The premask filter 120 acts as a wide-bandwidth bandpass filter which straddles the triple-mode mono-block 10, 12 passband response. Its passband is wider than the triple-mode mono-block 10, 12 resonator's passband. Therefore, it won't affect signals falling within the passband of the triple-mode mono-block resonator 10, 12. However, it will provide additional rejection in the stopband. Therefore, it will reject the first few spurious modes following the triple-mode mono-block resonator's 10, 12 passband. See FIG. 15.

In example 1, a filter assembly was designed for 3G application. In a preferred embodiment, it is used in a Wideband Code Division Multiple Access (WCDMA) base station. It had an output frequency of about $f_0$=2.00 GHz and rejection specification out to 12.00 GHz. The receive bandwidth is 1920 to 1980 MHz. The transmit bandwidth is 2110 to 2170 MHz. In the stopband for transmit mode, the attenuation needs to be 90 dB from 2110 to 2170 MHz, 55 dB from 2170 to 5 GHz and 30 dB from 5 GHz to 12.00 GHz. A preselect or mask filter 120 was selected with a passband from 1800 MHz to 2050 MHz and a 60 dB notch at 2110 MHz. Between 2110 MHz and 5 GHz it provides 30 dB of attenuation.

In example 1, the mask filter 120 has a 250 MHz bandwidth and is based on a 4-pole combline design with one cross coupling that aids in achieving the desired out-of-band rejection. A photograph of the mask filter 120 is shown in FIG. 16. FIG. 16(*a*) shows a 4-pole combline filter package. FIG. 16(*b*) shows the internal design of the 4 poles and the cross coupling. The SMA connectors shown in FIG. 16(*b*) are replaced by direct connections to the circuit board for the total filter package.

Low Pass Filter: It is common for a cellular base station filter specification to have some level of signal rejection required at frequencies that are several times greater than the pass band. For example, a filter with a pass band at 1900 MHz may have a rejection specification at 12,000 MHz. For standard combline filters, a coaxial low-pass filter provides rejection at frequencies significantly above the pass band. For the filter package disclosed here, the low pass filter 130 is fabricated in microstrip or stripline, and is integrated into (or etched onto) the circuit board that already supports and is connected to the mono-block filter 10, 12 and the mask filter 120. The exact design of the low pass filter 130 would depend on the specific electrical requirements to be met. One possible configuration is shown in FIG. 12.

While the invention has been disclosed in this patent application by reference to the details of preferred embodiments of the invention, it is to be understood that the disclosure is intended in an illustrative, rather than a limiting sense, as it is contemplated that modifications will readily occur to those skilled in the art, within the spirit of the invention and the scope of the appended claims and their equivalents.

What is claimed is:

1. A filter assembly, comprising:

a block resonator filter comprising a block of dielectric material having a conductive plating; and a means for tuning at least one of three resonant frequencies associated with the block resonator filter; and the tuning means comprising an affected area of the conductive plating having a determined shape for selectable increasing or decreasing the at least one resonant frequency, wherein a circular shape increases the resonant frequency, and a slot decreases the resonant frequency; and a mask filter operably connected to said block resonator filter, wherein a passband of said mask filter is wider than a passband of said block resonator filter; and a low-pass filter operably connected to said block resonator filter, wherein said low-pass filter rejects frequencies greater than the passband of said block resonator filter.

2. A filter assembly, comprising:

a block resonator filter comprising a block of dielectric material, having faces designated in terms of X, Y, and Z directions, and having a conductive plating, the block resonator filter characterized by three resonant modes, namely Mode 1=TE110, Mode 2=TE101, and Mode 3=TE011 with the TE fields designated for the x, y, and z directions; and a plurality of tuning elements, each adapted for tuning the resonant frequency of a different one of the resonant modes, substantially independent of the resonant frequencies of the other modes, said plurality of tuning elements each comprising an affected area where the conductive plating is removed from a face of the block resonator filter, and the tuning element is selected from among the following:

an affected area shaped like a slot in at least one of the following configurations, to decrease a frequency of resonance a slot along the X-direction in the X-Y face to decrease the resonant frequency of Mode 2, a slot along the X-direction in the X-Z face to decrease the resonant frequency of Mode 1, a slot along the Y-direction in the X-Y face to decrease the resonant frequency of Mode 3, a slot along the Y-direction in the Y-Z face to decrease the resonant frequency of Mode 1, a slot along the Z-direction in the X-Z face to decrease the resonant frequency of Mode 3, a slot along the Z-direction in the Y-Z face to decrease the resonant frequency of Mode 2, and at least one circular affected area placed in at least one of the following locations to increase a frequency of resonance on the X-Y face to increase the resonant frequency of Mode 1, on the X-Z face to increase the resonant frequency of Mode 2, and on the Y-Z face to increase the resonant frequency of Mode 3.

3. The filter assembly according to claim 2, wherein the at least one affected area is shaped like a slot, and the resonant frequency of the one mode is decreased as a length of the slot is increased.

4. The filter assembly according to claim 2, wherein the at least one affected area is shaped like a rectangular slot.

5. The filter assembly according to claim 2, wherein in the affected area is one of removed conductive plating and indented conductive plating.

6. The filter assembly according to claim 2, wherein the affected area comprises an area of the conductive plating having a decreased thickness with respect to the remaining conductive plating.

* * * * *